United States Patent [19]

Zacharkow

[11] Patent Number: 4,981,325

[45] Date of Patent: Jan. 1, 1991

[54] POSTURE SUPPORT WITH MULTI-PLANAR ADJUSTMENT

[76] Inventor: Dennis Zacharkow, 1532 - 10th St. SE., Apt. 6-C, Rochester, Minn. 55904

[21] Appl. No.: 236,144

[22] Filed: Aug. 25, 1988

[51] Int. Cl.[5] ..... A47C 3/00

[52] U.S. Cl. ..... 297/284; 297/231; 297/296; 297/353

[58] Field of Search ..... 297/284, 230, 231, 410, 297/383, DIG. 3, DIG. 8, 464, 354, 358, 353

[56] References Cited

U.S. PATENT DOCUMENTS 3,880,463 4/1975 Shepard ..... 297/284
4,313,637 2/1982 Barley ..... 297/284

FOREIGN PATENT DOCUMENTS 226408 8/1962 Austria ..... 297/284
26668 4/1981 European Pat. Off. ..... 297/284
2222532 11/1973 Fed. Rep. of Germany ..... 297/284
560109 4/1957 Italy ..... 297/231

*Primary Examiner*—Laurie K. Cranmer
*Attorney, Agent, or Firm*—D. L. Tschida

[57] ABSTRACT

A seating support for independent, multi-planar adjustable thoracic and pelvic-sacral cushions for supporting the spine and permitting support adjustment by the seated occupant. The thoracic support cushion is inflatably adjustable in a horizontal plane and vertically adjustable relative to apertured slide rails of a support framework. The pelvic-sacral support cushion vertically slide adjusts along the framework and is horizontally adjustable via a screw follower mounted scissors assembly having a laterally and tiltably rotatable cushion mounting plate. In an accessory embodiment, an adjustable clamp retainer and strap secure the support to an available rigid-backed chair.

13 Claims, 5 Drawing Sheets

POSTURE SUPPORT WITH MULTI-PLANAR ADJUSTMENT

BACKGROUND OF THE INVENTION

The present invention relates to posture supports and, in particular, to a support which is integrally adaptable to a chair back or separately mountable as an accessory item to the backrest of a variety of available chairs and wherein each of a pair of thoracic and pelvic-sacral support cushions are independently adjustable along a plurality of planar axes by the seated occupant.

With a growing awareness and appreciation of the ergonomics of the work place has come an attempt to design improved furnishings to facilitate the use of computers, drafting tables, motor vehicles and the like by the seated worker. Various of these designs seek to promote proper posture and thereby prolong the duration of meaningful equipment usage.

A variety of chair constructions and seating accessories have particularly evolved for supporting the spine of the seated occupant. Most of such endeavors have been directed to providing non-adjustable assemblies which promote a specific seating posture for each particular chair construction. That is, most typically, such designs provide for a single rigid convex backrest cushion which is secured to a reclined frame to support the lumber spine. Such constructions, however, do not promote any particular spinal posture when leaning forward. Nor do such constructions provide for a combination of support surfaces that accommodate a variety of seating postures; nor do they permit adjustment while seated.

In the above regard, Applicant is particularly aware of a number of single cushion support constructions shown in U.S. Pat. Nos. 2,060,298; 2,838,099; 2,831,533; 3,348,880; and 4,190,286. Various of these supports adjustably mount to a chair back and provide a mechanism for vertically positioning the cushion with the user's lumbar spine. One of these supports also provides for inflatable pneumatic cushions.

Applicant is also aware of other backrest supports which provide for a pair of support cushions for simultaneously supporting two regions of the back. These assemblies are shown in U.S. Pat. Nos. 567,096; 1,007,985; and 3,880,463 and in articles by E. H. Bradford and J. S. Stone, "The Seating of School Children", *Transactions of the American Orthopedic Association,* 12: 170–183 (1899) and by F. J. Cotton, "School Furniture for Boston Schools", *American Physical Education Review,* 9:267–284 (1904). Of these, probably the most relevant to the present invention is the assembly shown in U.S. Pat. No. 3,880,436. There, a pair of cushions are permanently mounted in fixed spatial relation to one another along an inner support frame which, in turn, is pivotally mounted to an outer frame. The cushions are vertically adjustable as a unit and may also be rotated or tilted as a unit. Otherwise, the cushions are not independently adjustable relative to one another or the inner frame, nor is either cushion separately tiltable. Thus the assembly provides only for a limited fitting to the user.

One other patent of which Applicant is aware, U.S. No. 2,304,349, shows a single cushion auxiliary backrest wherein the cushion adjusts both vertically and horizontally to contact the "small" or lumbar vertebrae of the user's back. Vertical adjustment is achieved with a spring loaded slide bracket, while horizontal adjustment is achieved with a pair of clamped ears which mount above a pivot stem. A tilting action is obtained with rotation of the clamp ears about a pivot pin and an extendible stop that strikes the cushion back.

To the extent applicant is aware of other references showing features directed to the concerns which are alleviated by way of the present invention, Applicant's own book, D. Zacharkow, *Posture: Sitting, Standing, Chair Design and Exercise* (Springfield, Thomas, 1988) discusses the need for a new support mechanism. Applicant is also aware of an article by Rizzi, M., "Entwicklung eines Verschiebbaren Ruckenprofils fur Auto-und Ruhesitze," appearing on pp. 112–119 in E. Grandjean, *Proceedings of the Symposium on Sitting Posture* (London, Taylor and Francis, 1969).

In contrast to the above noted art, the present invention seeks to provide a seating posture which mimics a preferred standing posture to not only erectly support the spinal column when seated, but also to reinforce and carry over this posture to standing movements. That is, the proper axial relationship of the thorax and pelvis in upright standing involves the upper trunk being brought over or slightly anterior to the hips. This posture is achieved through proper extension of the lower thoracic spine and thoracolumbar junction (i.e. ninth thoracic vertebra through first lumbar vertebra) and results in activation of the lower abdominal muscles, along with a beneficial increase in the resting intra-abdominal pressure.

This increase in intra-abdominal pressure is beneficial for the following reasons:

(1) It promotes proper diaphragmatic excursion and respiration.

(2) It raises the ribs and chest to their most optimal position.

(3) It prevents stagnation of the circulation in the splanchnic region.

(4) It provides stabilization of the trunk.

(5) It reduces spinal stress to the thoracic and lumbar spine by both lengthening and extending the spine. A secondary effect is that the cervical spinal posture is improved.

As opposed to the above beneficial posture, the most common standing postural fault involves a posterior trunk lean, with the upper trunk being displaced posterior to the hips. Such a posture results in relaxation of the lower abdominals and a decrease in intra-abdominal pressure.

Similarly, in a sitting position, relaxation of the lower abdominals and a decrease in intra-abdomimal pressure results from:

(1) Slumped sitting postures with the thoracolumbar spine in flexion. This frequently occurs both when leaning forward, such as over a desk, and in most reclined postures.

(2) sitting with a convex lumbar support that moves the lumbar spine into lordosis. Such a sitting posture will result in a posterior trunk lean, with the upper trunk being brought posterior to the hips.

(b 3) Conventional backrest designs that include a high, inclined backrest, but without proper lower thoracic support to promote extension.

(b 4) A forward inclination to the upper backrest, thereby pushing the shoulders forward and increasing thoracic flexion.

(5) Inadequate space just above the seat for the posterior placement of the buttocks and clothing, thereby preventing the hips from being pushed back.

SUMMARY OF THE INVENTION

It is accordingly a primary object of the present invention to provide a posture support wherein the support cushions are independently adjustable in multiple planes and which may be integrally constructed as part of a chair or added as an accessory item to existing chairs.

It is another object of the invention to independently stabilize and support the pelvis and lumbar spine by supporting the upper sacrum and posterior iliac crests.

It is a further object of teh invention to provide an assembly including a pair of independently adjustable, thoracic and pelvic-sacral support cushions.

It is a still further object of the invention to provide a framework including a thoracic support cushion which is vertically and horizontally adjustable and may include a chair retainer assembly.

It is another object of the invention to provide a pelvic-sacral support cushion which is independently verticallY and horizontally adjustable, and which is tiltable to mate with the user's pelvic-sacral region.

It is another object of the invention to provide at least one cushion with a laterally and tiltably adjustable cushion mounting plate.

It is yet another object of the invention to provide an assembly wherein the position of each cushion may be varied by the seated occupant.

Various of the foregoing objects and advantages of the invention are particularly obtained in a presently preferred embodiment which may replace a conventional chair back and/or be mounted as an after market item to a suitable chair. In either construction, the assembly comprises an inverted, U-shaped tubular framework which provides a plurality of apertures along right and left slide rails. In the preferred construction, the slide rails are the lateral side framework rails, although they might comprise other dedicated purpose rails. Slideably, restrainedly mounted along each rail are a pair of upholstered, support cushions which are independently adjustable along multiple planar axes.

In a preferred accessory assembly, the thoracic support cushion is inflatable and the inflation level of which provides horizontal cushion adjustment and permits the conformal mounting of the cushion to a variable surface area of the user's back. Secured to the cushion back is an adjustable retainer clamp which, in turn, secures the upper end of the assembly to the chair back. A strap assembly secures the lower end of the framework to the lower chair back. Spring biased pins mounted to cushion slides fix the thoracic support cushion height relative to the framework.

An included pelvic-sacral support cushion is also vertically, slide mounted and restrained to the framework with spring pins. The foam padded cushion is horizontally extendible via a scissors acting screw follower assemblY mounted between the side frame members and is operable by the seated occupant via a side mounted hand wheel, upon reaching rearward to the chair's side. A cushion mounting plate secured to the fore-end of the horizontal adjustment assembly is separately adjustable in the fashion of a ball-and-socket joint to permit lateral adjustment and tilt fitting of the cushion to the sacrum.

The subject support assembly and individual support cushions may therefore be advantageously employed in a variety of seating environments in the office and factory as well as in conjunction with motor vehicles and seating for the handicapped.

The foregoing objects, advantages and distinctions of the invention, among others, as well as alternative constructions will become more apparent upon reference to the following detailed description with respect to the appended drawings. Before referring thereto, it is to be appreciated that the following description is made by way of the presently preferred embodiment only, which should not be interpreted in limitation of the spirit and scope of the invention claimed hereinafter. To the extent modifications and/or improvements have been considered they are described as appropriate.

DESCRIPTION OF THE PREFERRED EMBODIMENT

Figure 1:
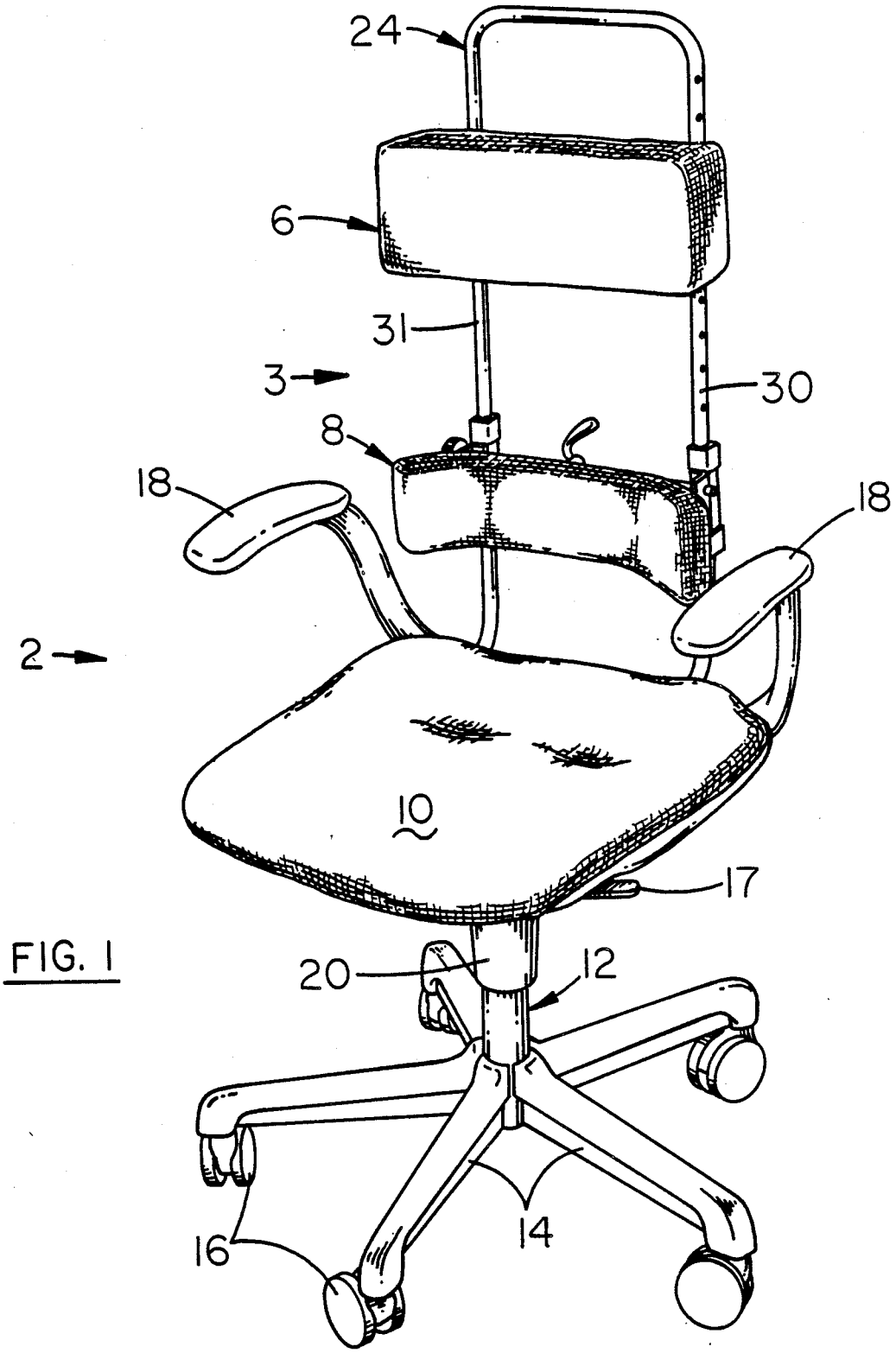
FIG. 1 shows an isometric view of the invention when incorporated as an integral, permanent chair back.
Figure 2:
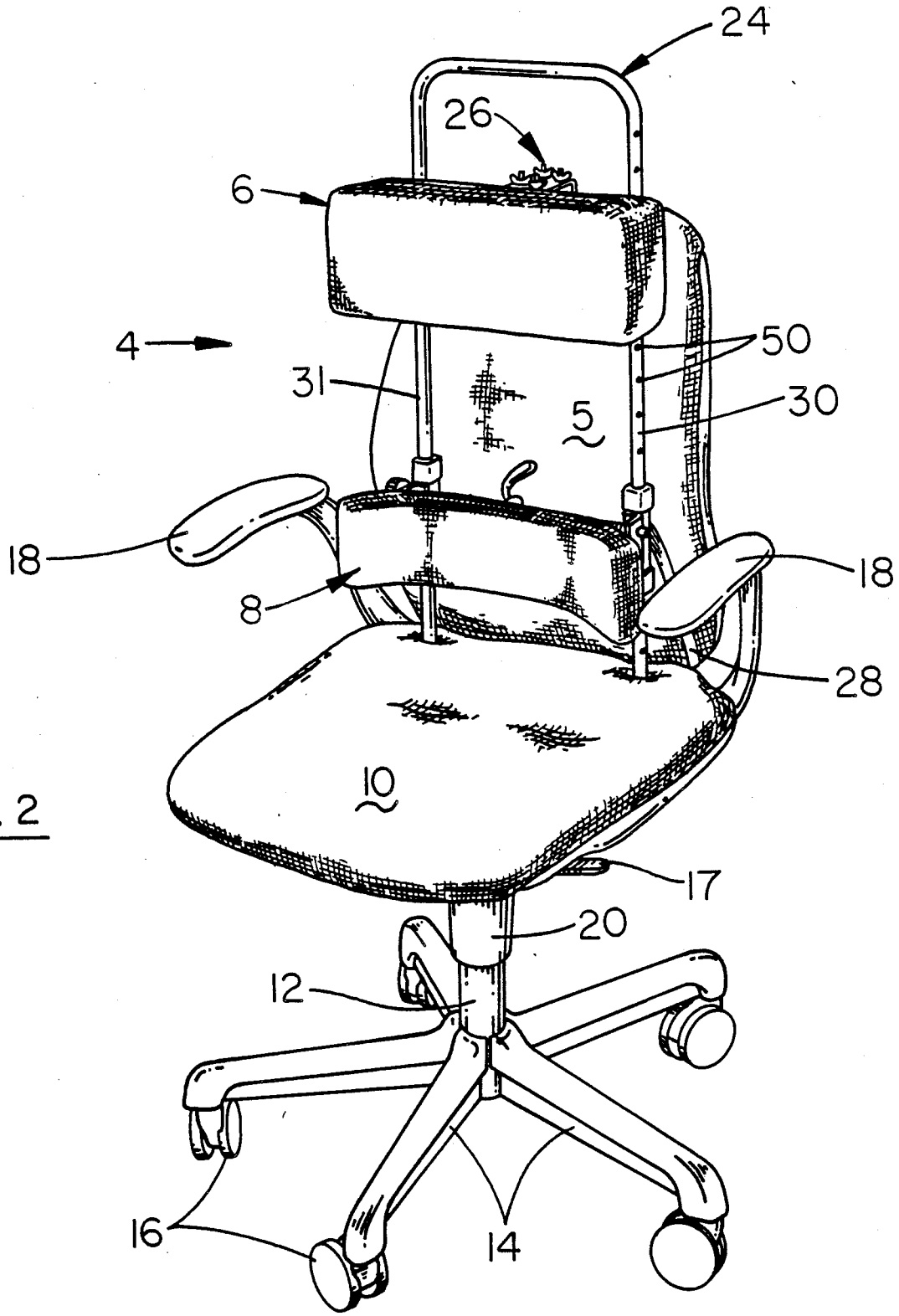
FIG. 2 shows an isometric view of an accessory support assembly to a rigid-backed chair.

Referring to FIGS. 1 and 2, FIG. 1 shows an isometric view of a multi-castered chair 2 including an integrally constructed, posture improving backrest support assembly 3. FIG. 2 shows a similar chair construction to that of FIG. 1 but wherein a detachable, accessory posture support assembly 4 is secured to a permanent cushioned chair back 5. Each support 3 and 4 includes a pair of adjustable back support cushion assemblies 6 and 8 which are independently adjustable in multiple planar axes relative to the user's spine. The details of the support assemblies 3 and 4 are particularly shown in FIGS. 3–5 and will be described hereinafter with reference thereto. However, before referring to FIGS. 3–5, the construction of the lower portion of each chair will be briefly discussed.

In that regard, it is to be noted each chair includes an upholstered foam cushion seat 10 which is supported on a height adjustable pedestal 12 and from the base of which radiate a number of legs 14. Each leg 14 includes a caster 16 secured to an outer end. A pair of cushioned arms 18 extend from each side of the seat cushion 10.

The pedestal 12 is hydraulically controlled and may be raised and lowered via the actuation of a side-mounted lever member 17 to induce the filling/evacuation of an internal hydraulic chamber (not shown) with a consequent raising/lowering of an upper-support piston 20 and the supported seat 10. Alternatively, a screw adjustable pedestal mechanism might be employed or any other type of readily available height adjustment mechanism. Similarly, the bottom seat support (not shown) which couples between the upper end of the pedestal 12 and seat 10 might provide for a tilt mechanism, whereby the seat 10 may be tilted rearward with the shifting of an operator's weight. Preferably, however, the basic chair should provide for a rigid seat 10 and chair back 5, since a seat tilt mechanism is not conducive to proper posture.

Although the chair construction shown has found wide acceptance in the typical office setting, it is to be appreciated that the support assemblies 3 and 4 are adaptable to a variety of other chair configurations, such as drafting chairs, wheelchairs, chairs without pedestals and motor vehicle seats, such as for a car, truck, tractor and/or motorcycle. Moreover, a variety of differently configured seats 10, backs 5, pedestals 12, legs 14 and arms 18 might be combined with one another and the presently improved posture supports 3 and 4 in a variety of integral constructions. Depending too upon the design of an existing chair, a variety of currently available chairs and seats for the able-bodied or handicapped user might be advantageously modified to utilize the support assemblies 3 and 4.

When, however, modifying a chair, such as the chair of FIG. 2, to include an accessory backrest 4, care must be taken that a sufficient seat width and depth are available to accommodate the accessory backrest 4, Yet provide sufficient room to properly support the buttocks and thighs of the seated user. The support assembly 4 is therefore sized to be approximately 13 inches wide, 25 inches tall and 3 to 5 inches deep and whereby a seat depth of only 13 to 15 inches from the anterior edge of the pelvic-sacral support cushion assembly 8 is required to accommodate the support 4. Thus, a wide variety of chairs may be adapted over to take advantage of the improvements of the present invention.

By also varying the existing design of the support framework and recessing the support cushion assemblies 6 and 8 into the framework, additional space may be gained. Such modifications, however, are believed readily suggestible to those skilled in the art and may be effectuated as necessary in still other alternative constructions of the invention from those disclosed herein.

Figure 3:
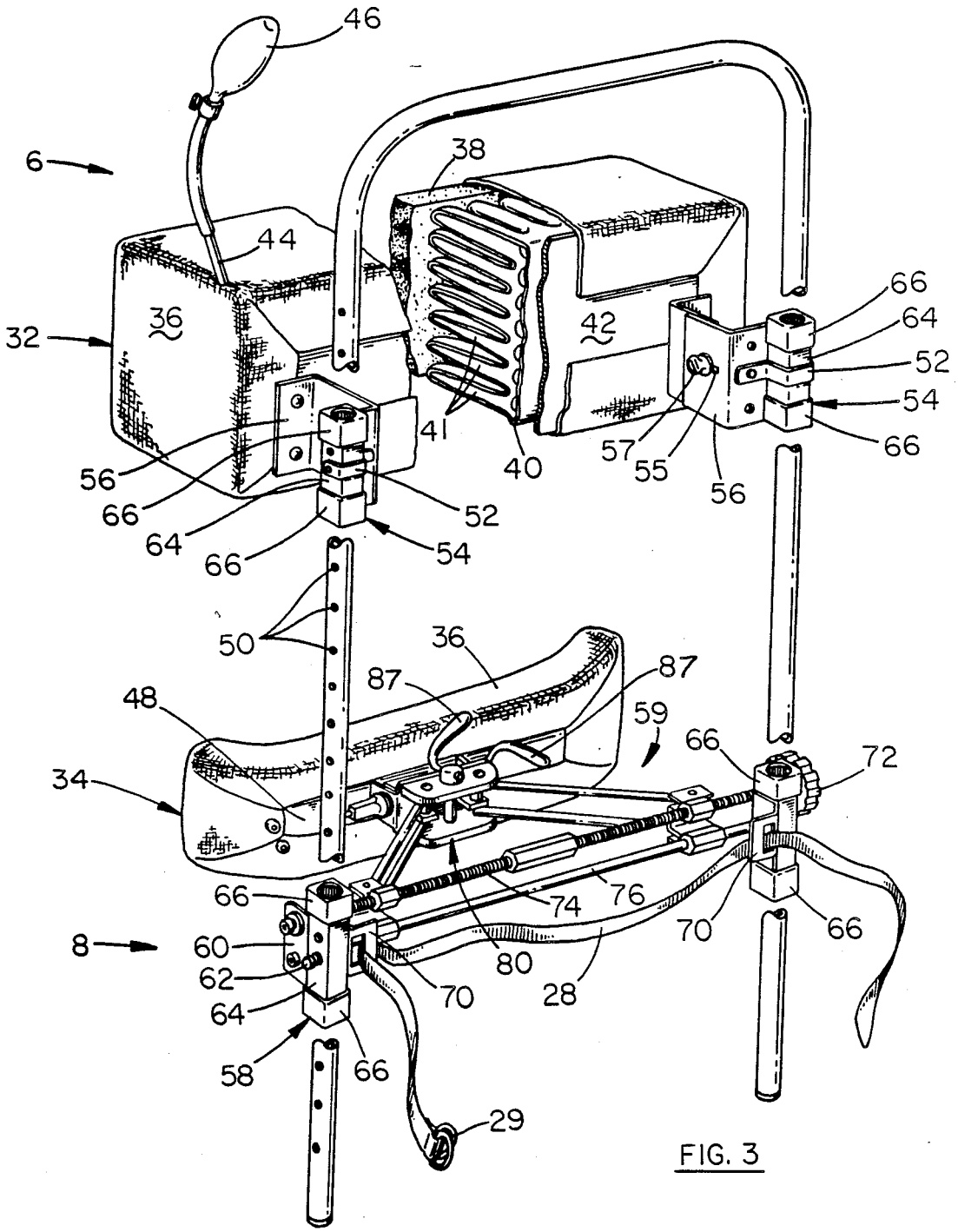
FIG. 3 shows an isometric view from the rear and in exploded assembly of the accessory back support of FIG. 2 and wherein the thoracic support cushion is shown in partial cutaway.

With continuing attention to the backrest support portions 6 and 8 of FIGS. 1 and 2 and additional attention directed to the exploded assembly of the accessory backrest 4 of FIG. 3, each assembly 3 and 4 is comprised of an inverted U-shaped tubular framework 24 which verticallY rises from the rear of the seat 10. The lower ends of the side frame members 30, 31 in the integral embodiment of FIG. 1 are mounted directly to the seat bottom, although they may be mounted within mating sockets (not shown) provided in a seat bottom support or in some other conventional fashion. Otherwise, the framework 24 of the assembly 4 is secured to the upper chair back with an adjustable clamp retainer 26 and to the lower chair back with a strap assembly 28 having at least one length adjustable end coupler 29. In either case, however, the framework 24 is rigidly supported in upright relation to the seat 10.

Independently, slideably mounted between the right and left side frame members 30, 31 is the thoracic support cushion 32 which may either present a flat or a concave outer surface. The cushion 32 is intended to support the chair occupant's back in the region of the lower thoracic spine and thoracolumbar junction (i.e. ninth thoracic vertebra through first lumbar vertebra). Independently mounted beneath the thoracic support cushion 32 is a concave pelvic-sacral support cushion 34 which also is slideably mounted between the side rail members 30, 31 and supports the sacrum and posterior iliac crests. Upon mounting the support 4, the cushions 32, 34 are each typically adjusted to an initial vertical support position and then individually adjusted by the user to the proper horizontal depth and tilt angle, while seated. Thus the support is fitted to the user to the most advantageous position, but may also be adjusted from time-to-time, as necessary.

The thoracic cushion 32 is constructed of an outer durable cover material 36 and beneath which are found a foam layer 38, an inflatable support 40 (shown in cutaway) and a rigid backing member 42 . The support 40 provides for a single inflatable cell having a number of chambers which overlap one another and which is filled by way of a valve stem 44 and removable air pump 46. Each of the chambers 41 of the support 40 are coupled to one another such that all are inflated equally. It is to be appreciated, however, that the cushion 40 might be constructed in a segmented configuration, whereby each of a plurality of separately inflatable segments might be separately inflated/deflated relative to the others and the user.

Moreover and in lieu of an inflatable base, the support can be constructed such that a number of differing thickness, covered foam pads are removably mountable to the backing member 42. For example, a Velcro TM brand fastener material might be used to selectively secure a desired thickness pad to the member 42 to provide the proper depth adjustment.

The cushion 40 also extends full width and is approximately 5 inches tall. Depending upon the inflation pressure, which is determined as the cushion is filled by the seated occupant, a horizontal depth adjustment in the range of 4 to 6 inches can be obtained relative to the user's back. Upon receiving a user's back, the cushion 40 compresses inward to provide a uniform support across its outer surface.

Whereas the thoracic support cushion 32 is inflatable, the pelvic-sacral cushion 34 is not, although it might be so constructed, if desired. Instead, it comprises an outer durable cover 36 material which overlies a foam core (not shown) and a concave backing plate 48.

Otherwise, the thoracic support cushion 32 and pelvic-sacral cushion 34 are each slideably mounted to the side frame members 30, 31 and whereby they can be independently raised/lowered to the proper position relative to the seated user. This normally occurs in a trial and error process before the depth and angular orientation of each cushion 32,34 are established.

In particular, a plurality of apertures 50 are formed in each side rail member 30, 31 at a nominal 1 inch spacing and provide for a broad range of adjustability of the support cushion 32 and 34 relative to one another. A selected thoracic cushion position is maintained via the insertion of a pair of spring biased clip/pins 52 into opposite ones of the apertures 50. The pins are mounted to right and left slide assemblies 54, that, in turn, are mounted to offset brackets 56 which extend between the cushion backing plate 42 and each side rail 30, 31. Although the left bracket 56 is shown of fixed length it is . to be appreciated that it might be depth adjustable as by way of an exemplary slot 55 and fastener 57 shown for the right bracket 56.

Figure 4:
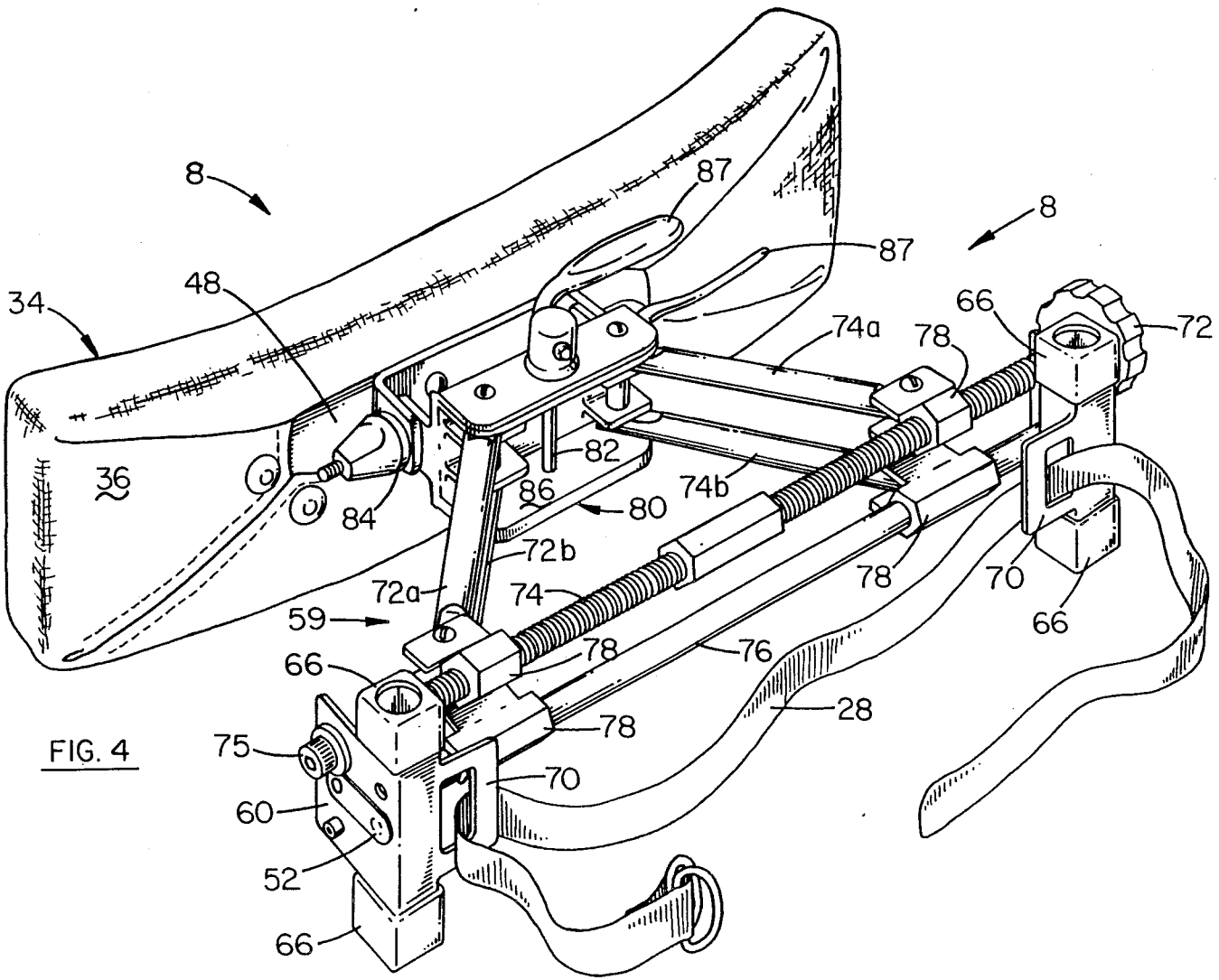
FIG. 4 shows a detailed isometric view from the rear of the pelvic-sacral support cushion in an extended position and wherefrom the multi-planar, user-adjusted adjustment assemblies are more apparent.

Similarly coupled to the right and left sides of the pelvic-sacral cushion 34 are slide assemblies 58 which may also include spring clip/pins 52, such as in FIG. 4, or as depicted in FIG. 3, a press fit, spring-biased stud 62. Each assembly 58 is adjustably secured to the cushion backing plate 48 via an extension bracket 60 which mounts to one end of a screw-follower adjustment assembly 59 described below. In any event, though, the mounting height of the pelvic-sacral cushion 34 and thoracic cushion 32 may be independently established .

Each slide assembly 54, 58 otherwise comprises a tubular member 64 having a pair of bored nylon end caps 66 which are mounted about the side rails 30, 31. Also extending inward from the slide assemblies 58 are individual loop members 70 which receive the mounting strap 28.

With particular attention next directed to FIG. 4 and the pelvic-sacral cushion adjustment assembly, a knob or hand wheel 72 is rotatably mounted relative to the right offset bracket 60. A threaded rod 74 extends from the wheel 72 to the left bracket 60 and is rotatably secured at each bracket 60 via an end cap 75. A lower rod 76, in turn, is fixedly mounted between the right and left brackets 60. Threadably mounted along opposite sides of the rod 74 and slideably mounted to the rod 76 are upper and lower pivot blocks 78 which support upper and lower pivot arm pairs 72*a,b* and 74 *a,b* which extend to a separately adjustable, multi-axis backing plate assembly 80 secured to the back 48 of the pelvic-sacral cushion 34.

In combination, the knob 72, rods 74, 76, pivot blocks 78 and pivot arms 72*a,b* and 74 *a,b* generally provide a screw follower/scissors action which horizontally extends/retracts the pelvic-sacral cushion 34 relative to the seated individual as the knob 72 is rotated. As important, the knob 72 is positioned to be accessible to the seated occupant and whereby the occupant can adjust the horizontal cushion depth, while seated. This is especially important to permit adjustment of the depth from time to time to accommodate forward leaning, etc.

The backing plate assembly 80 is separately adjustable in the fashion of a ball-and-socket type joint and permits a lateral and tilting adjustment of the cushion 34. Although a true ball-and-socket joint may be used, at present, a multi-axial adjustment is obtained via a pair of compressively mounted, vertical and horizontal pivot axle assemblies 82 and 84 which mount to a compound bracket 86. Upon releasinq/securing the end handles 87, which again can be done while seated, the cushion 34 can be securely fitted to the sacrum.

Whereas, too, the assembly 80 provides for a multi-axial adjustment, it is to be appreciated the principal concern is to provide an adjustable tilt angle in combination with the described vertical and horizontal adjustment capabilities, and whereby the spine may be supported when either sitting erect or when leaning forward. Preferably, the cushion 34 is adjusted to bear against the spine in the region of the S1 to S3 sacral vertebrae with the tilt angle being varied to accommodate the seated occupant's specific sitting posture and unique sacral contour.

In summary, therefore, each of the thoracic and pelvic-sacral cushions 32 and 34 are independently adjustable in a plurality of planes relative to the rigid seat 10 and whereby the proper cushioning support may be brought to bear against the user's vertebrae to maintain the upper trunk over the hips. The lower abdominal muscles are thereby activated and the buttocks and thighs are properly supported on the seat 10. Moreover, the present supports 3 and 4 provide pelvic-sacral stabilization, even if the user leans forward such as to write at a horizontal desk, and the ability for the user to make necessary adjustments, while seated.

Re-directing attention to FIG. 2, and the accessory embodiment 4 of the invention. It, again, is preferably secured to a rigid backed chair having a sufficient seat depth to accommodate the depth dimension of the assembly 4 and the necessary seat space for the user. The principle difference therefore over the assembly of FIG. 1 is that an adjustable retainer clamp assembly 26 is required which adjustably extends perpendicular from the upper, rear surface of the thoracic cushion 32 to clamp-mount to the chair back 5.

Figure 5:
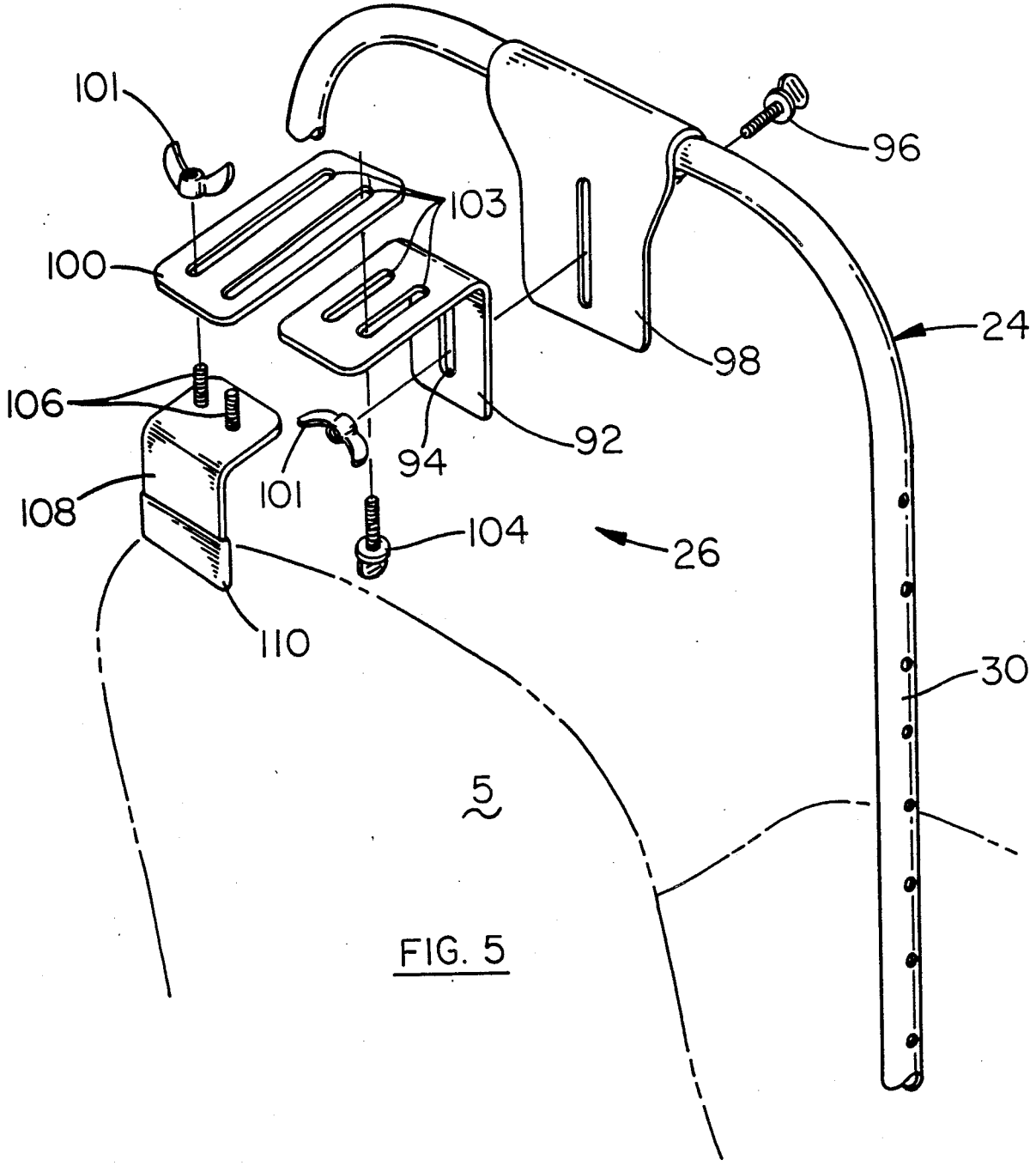
FIG. 5 shows a partial isometric view of a chair frame including an alternative retainer clamp assembly.

In particular, and with attention also directed to FIG. 5, the clamp assembly 26 is constructed of three overlapping members formed from a flat metal stock, approximately 2 inches wide. Whereas the assembly of FIG. 5 mounts to the upper end of the framework 24, the assembly 26 adjustably bolts to the backing plate 42. In either case, though, let into a vertical arm member 92 is at least one elongated slot 94 and relative to which a threaded member 96 extends from either the backing plate 42 of the thoracic cushion 32 or a mating slotted member 98 secured to the framework 24 to establish a desired vertical clamp position upon tightening a mating wing nut 101.

The depth separation of the clamp assembly 26 is determined by adjusting the length of a mating horizontal arm member 100 and one end of which is adjustable relative to a pair of overlapping slotted channels 103 via wing nut/bolt fasteners 101,104 secured therethrough. An opposite end of the slots 103 is restrained to press fit studs 106 extending from a clamp arm 108. The overall length of the horizontal arm portion 100 is typically adjusted to bring the clamp member 108 into constrained relation with a chair back 5 and thereby rigidly secure the assembly 4 to the chair. A protective cover 110 on the forward vertical leg portion of the clamp arm 108 protects against marring of the chair back and/or damage to the fabric. Depending upon the chair back 5, upon pulling the brackets tight, a spring bias may be exerted by the cushion. Alternatively, though, the assembly 26 might also be constructed of a spring metal.

While the present invention has been described with respect to its presently preferred and various alternative embodiments, it is to be appreciated that still other equivalent constructions might suggest themselves to those skilled in the art. Accordingly, the following claims should be interpreted to include any such equivalent embodiments within the spirit and scope of the following claims.

What is claimed is:

1. Posture support apparatus comprising:

(a) a framework including first and second vertical slide rails;

(b) first and second back support cushions;

(c) first means coupled to each of said first and second slide rails and said first support cushion for selectively establishing a vertical mounting position and a horizontal extension of said first cushion relative to said first and second slide rails independent of the second support cushion;

(d) second coupled to each of said first and second slide rails and said second support cushion for selectively establishing a vertical mounting position of said second cushion relative to said first and second slide rails and including third means for selectively establishing a fixed angular tilt orientation of said second cushion relative to a plane containing said first and second slide rails;

(e) wherein said first means includes first and second brackets horizontally extending from said first cushion, wherein each of said first and second means includes first and second retainer means, wherein each retainer means is slidably mounted relative to one of said first and second slide rails and includes means for fixing the retainer means to the slide rail, and wherein the retainer means of said first means includes means for fixing the relative extension of one of said brackets thereto;

(f) means for securing said framework to a chair having at least a seat and a plurality of seat support legs; and (g) wherein said first and second means cooperatively permit the adjustment of said first and second support cushions to support the lower thoracic and upper sacral vertebrae of a seated occupant.

2. Apparatus as set forth in claim 1 wherein each retainer means includes a tubular member slidably mounted about one of said first and second slide rails and having a spring member biasing a plunger relative to a selected one of a plurality of mounting apertures formed in each slide rail.

3. Apparatus as set forth in claim 1 wherein the chair securing means comprises:

(a) extensible clamp means for securing an upper end of said framework to a rigid chair back; and (b) strap means for securing a lower end of said framework adjacent said seat.

4. Apparatus as set forth in claim 1 wherein at least one of said first and second cushions includes at least one inflatable cell and means for controllably varying the inflation pressure of said cell.

5. Apparatus as set forth in claim 1 wherein said first means includes:

(a) a threaded rod rotatively supported between said first and second slide rails; and (b) at least one carrier mounted in screwfollower relation to said threaded rod and pivotally supporting at least one arm member having an opposite end coupled to said second cushion such that said arm member extends and retracts said second cushion relative to said first and second slide rails as said rod is rotated.

6. Apparatus as set forth in claim 1 wherein said third means comprises a bracket mounted to said second cushion having a first portion pivotally mounted to a vertical pivot axle and a second portion pivotally mounted to a horizontal pivot axle whereby said first and second bracket portions are independently rotatively mounted relative to one another and further including means for separately restrainedly securing said vertical and horizontal pivot axles to said bracket.

7. Apparatus as set forth in claim 1 wherein at least one of said first and second cushions is horizontally inflatably adjustable.

8. Posture support apparatus comprising:

(a) a framework including first and second vertical slide rails;

(b) first and second back support cushions;

(c) first means coupled to each of said first and second slide rails and said first support cushion for selectively establishing a vertical mounting position and a horizontal extension of said first cushion relative to said first and second slide rails;

(d) second means coupled to each of said first and second slide rails and said second support cushion independent of said first means for selectively establishing a vertical mounting position and a horizontal extension of said second cushion relative to said first and second slide rails independent of said first cushion;

(e) means for securing said framework to a chair having at least a seat and a plurality of seat support legs; and (f) wherein said first and second means cooperatively permit the adjustment of said first and second support cushions to support the lower thoracic and upper sacral vertebrae of a seated occupant.

9. Apparatus as set forth in claim 8 wherein at least one of said first and second means includes:

(a) a threaded rod rotatively mounted between first and second brackets secured to and slidably supported along the respective first and second slide rails; and (b) a first carrier mounted in screw-follower relation along said threaded rod and having an arm member pivotally coupled to the associated cushion such that said arm member horizontally extends and retracts the associated cushion relative to a plane containing said first and second slide rails as said threaded rod is rotated; and (c) means coupling said arm member to the cushion for selectively establishing a fixed angular tilt orientation of the cushion relative to said plane

10. Apparatus as set forth in claim 9 including:

(a) a second carrier mounted in screw follower relation along said threaded rod;

(b) a second rod extending between said first and second brackets and supporting said first and second carriers in slidable relation thereto; and (c) wherein a pair of arm members pivotally couple each of said first and second carriers to said tilt means.

11. Apparatus as set forth in claim 9 wherein said tilt means comprises a body member including a first portion pivotally mounted to a vertical pivot axle and a second portion pivotally mounted to a horizontal pivot axle whereby said first and second portions are independently rotatively mounted relative to one another and further including means for separately restrainedly securing said vertical and horizontal pivot axles to said body member.

12. Apparatus as set forth in claim 8 wherein at least one of said first and second cushions is inflatably adjustable.

13. Apparatus as set forth in claim 8 wherein said second means includes third means for selectively establishing a fixed angular tilt orientation of said second cushion relative to a plane containing said first and second slide rails.

* * * * *